US009016693B1

(12) United States Patent
Shek et al.

(10) Patent No.: US 9,016,693 B1
(45) Date of Patent: Apr. 28, 2015

(54) PACKING SEAL FOR RECIPROCATING PUMP

(71) Applicant: FAST Group-Houston, Inc., Humble, TX (US)

(72) Inventors: Lee Shek, Houston, TX (US); Brian James, Humble, TX (US); Cathy G. Edgington, Spring, TX (US); Scott Schuette, Spring, TX (US); Hung Nguyen, Manvel, TX (US); Kurt Hayden, The Woodlands, TX (US)

(73) Assignee: FAST Group-Houston Inc., Humble, TX (US)

( * ) Notice: Subject to any disclaimer, the term of this patent is extended or adjusted under 35 U.S.C. 154(b) by 197 days.

(21) Appl. No.: 13/748,892

(22) Filed: Jan. 24, 2013

Related U.S. Application Data

(60) Provisional application No. 61/590,400, filed on Jan. 25, 2012.

(51) Int. Cl.
*F16J 15/00* (2006.01)
*F16J 15/16* (2006.01)
*F04B 39/00* (2006.01)

(52) U.S. Cl.
CPC ..... *F04B 39/00* (2013.01)

(58) Field of Classification Search
CPC ..... F16J 15/32; F16J 15/40
USPC ..... 277/510–512, 514–516, 540, 541, 585, 277/603
See application file for complete search history.

(56) References Cited

U.S. PATENT DOCUMENTS

| | | | | |
|---|---|---|---|---|
| 2,538,198 | A | 1/1951 | Hosford | |
| 3,016,826 | A | 1/1962 | Sage | |
| 3,120,960 | A | 2/1964 | Pippert et al. | |
| 4,106,779 | A * | 8/1978 | Zabcik | 277/322 |
| 4,138,144 | A | 2/1979 | Pierce, Jr. | |
| 4,169,604 | A | 10/1979 | Heathcott | |
| 4,371,177 | A | 2/1983 | Bahr et al. | |
| 4,438,935 | A | 3/1984 | Lees | |
| 4,440,404 | A | 4/1984 | Roach et al. | |
| 4,474,382 | A | 10/1984 | Hjelsand | |
| 4,478,423 | A | 10/1984 | Hjelsand et al. | |
| 4,592,558 | A | 6/1986 | Hopkins | |
| 5,230,520 | A | 7/1993 | Dietle et al. | |
| 5,265,890 | A | 11/1993 | Balsells | |

(Continued)

FOREIGN PATENT DOCUMENTS

| | | |
|---|---|---|
| EP | 1795786 B1 | 6/2007 |
| WO | WO 99/50578 A1 | 10/1999 |

*Primary Examiner* — Gilbert Lee
(74) *Attorney, Agent, or Firm* — Shumaker, Loop & Kendrick, LLP

(57) ABSTRACT

A packing seal for a reciprocating pump of the type typically used in connection with oil and gas drilling operations is described. Generally, the seal includes a rigid L shaped cartridge that carries an outer wiper and an O-ring on an exterior wall and a recessed seal body on an interior wall. The recessed seal body is of dual durometer, and its lower portion is constantly urged against the cylinder wall in self-sealing fashion. The seals, cartridge and wiper may be formed from rigid and/or non-rigid materials having low coefficients of friction and physical properties comprising low abrasion and wear resistance. The seal provides an improved self-lubricated unitary seal that is convenient to replace in the field regardless of the torque delivered to the gland nut of a packing box, which contains the seal.

21 Claims, 2 Drawing Sheets

(56) References Cited

U.S. PATENT DOCUMENTS

| | | | | |
|---|---|---|---|---|
| 5,431,415 | A | 7/1995 | Millonig et al. | |
| 5,678,829 | A | 10/1997 | Kalsi et al. | |
| 5,755,372 | A * | 5/1998 | Cimbura, Sr. | 277/318 |
| 5,842,701 | A | 12/1998 | Cawthorne et al. | |
| 6,007,106 | A | 12/1999 | Wilkins | |
| 6,209,882 | B1 | 4/2001 | Riess | |
| 6,616,146 | B2 | 9/2003 | Friend et al. | |
| 6,840,520 | B2 | 1/2005 | Faas et al. | |
| 6,910,692 | B2 | 6/2005 | Malone et al. | |
| 7,562,878 | B2 | 7/2009 | Dietle et al. | |
| 7,637,508 | B2 * | 12/2009 | Montipo | 277/514 |
| 8,201,832 | B2 | 6/2012 | Kocurek | |
| 2004/0119241 | A1 | 6/2004 | Castleman | |
| 2008/0217864 | A1 | 9/2008 | Johnson et al. | |
| 2009/0166980 | A1 | 7/2009 | Miller et al. | |
| 2010/0059937 | A1 | 3/2010 | Castleman et al. | |
| 2010/0181733 | A1 | 7/2010 | Nakamura et al. | |

* cited by examiner

PACKING SEAL FOR RECIPROCATING PUMP

REFERENCE TO RELATED APPLICATION

This application claims priority to U.S. Provisional Application No. 61/590,400, filed Jan. 25, 2012, which is hereby incorporated by reference.

BACKGROUND OF THE INVENTION

The invention relates to seals used in connection with oil and gas extraction wells and, more particularly, a packing seal for a reciprocating pump.

Hydraulic fracturing is used for removal of petroleum, natural gas, coal seam gas and other flowable substances from beneath the earth's surface. Highly pressurized fluid is forced into a wellbore to create new fractures in a rock layer. After creating the fracture it is desirable to maintain the fracture width since this increases extraction rates and recovery of fossil fuels. Thus, material such as sand, ceramic, or other particulate, which is known as proppant, is mixed with the fluid and injected into the fracture to keep it open. The abrasive nature of the particulates, however, wreaks havoc on the piston/cylinder assemblies of the high-pressure pumps used in "fracking."

When the particulates are allowed between the walls of the bore/plunger assemblies, loss of pressure results. Keeping them from reaching between the bore and cylinder plunger, therefore, is essential for seal duration. Well service packing (WSP) is typically used to seal the gap and permit slidable engagement. The packing is a collection of ring-shaped seals contained in a bore, known in the art as a "stuffing box," and arranged in order so as to incrementally ride against the wall of the plunger and seal it at the fluid end. The bore receives the reciprocating plunger making replacement of all of the seals, which often must be done in the field, more manageable and convenient.

At the time of this writing, frictional wear of the header ring is perhaps at its worst. This is because the proppant now preferred in frac jobs has become smaller and smaller in size. To make matters worse, the seal has to withstand a range of different fluid pHs, too. That is, the pressurized fluid may be cement (mildly acidic) instead of water (neutral), for example. The material from which the seals are made, therefore, must be matched with a set of desired physical properties. Prior seals are made from elastomeric composites, which can be abrasive to the stuffing box even if there is no proppant between the seal and box. The seals are subjected to extremely high pressures and a broad range of operating temperatures as well. Hence, wear and tear of the seals are constant concerns.

Besides problems caused by not properly cleaning the contacting surfaces when replacing seals in the field, sealing problems are exacerbated by the mechanics of the stuffing box. Packing is secured in the box mechanically and secured about the plunger with a gland nut. If the nut is too tight, the header ring, which may be formed from a compressible material, may be extruded back into the fluid end, and the seal will fail. Conversely, if the gland nut is too loose, the seal assembly will move back and forth in the stuffing box causing wear and eventual failure of the seal. "Hammering" and damage to the metal adapter also results when the nut is too loose. Assuming the gland nut is properly secured, still, it may back off due to vibration of the pump.

There, therefore, remains a need for an improved packing seal for a reciprocating pump. It would be advantageous if such a seal was a single, unitary seal to ease shipping and handling. Another need is for the seal to handle otherwise excessive axial force delivered to the stuffing box by way of the gland nut without deleterious effect to the soft seal portions of the packing. The present invention is directed toward meeting this need.

SUMMARY OF THE INVENTION

The invention relates to a packing seal for a reciprocating pump of the type typically used in connection with oil and gas extracting operations. Generally, the seal includes a rigid cartridge that carries an outer wiper and an O-ring on an exterior wall and a recessed seal body on an interior wall. The cartridge shell prevents extrusion of the soft seal components into the fluid end of the wellbore even when excessive torque is accidentally applied to the gland nut. The seals, cartridge and wiper may be formed from rigid and nonrigid materials having low coefficients of friction and physical properties comprising low abrasion and wear resistance. The recessed seal body is of a dual durometer, and its lower portion is constantly urged against the cylinder wall in self-sealing fashion. The seal provides an improved unitary seal that is convenient to replace in the field because numerous ring components do not have to be handled and assembled into the stuffing box.

The seal has an outer seal cartridge having a rigid body that defines an open top, an open bottom and an inner wall portion with an inner wall surface for contacting a plunger. The body is L shaped so that the cartridge body extends across the full width of the seal at the top of the cartridge but not at the bottom. Thus, a seal spine is defined. The inner wall portion includes an interior annular recess. There is a seal body in the recess, which includes a primary seal and a harder secondary seal. The primary seal has an inner wall portion for contacting the plunger. The inner wall portion of the primary seal includes a flat top, a flat bottom, and an inwardly sloped portion connecting the top and bottom portions. The primary seal has an annular undercut in which resides a coil spring for urging at least the flat bottom of the inner wall portion against the plunger. The secondary seal also has an inner wall portion for contacting the plunger at a location above that where the primary seal does. An annular recess is formed in an outer wall portion of the seal cartridge. An outer wiper located in the recess wipes a wall of a bore, or stuffing box. The outer wiper has a top flat portion, a bottom flat portion, and an outwardly sloped middle portion connecting the top and bottom portions.

In another aspect of the invention, the outer wiper is formed from a nonabrasive elastomer.

In another aspect, the body of the seal cartridge comprises an outer wall portion having a top with an O-ring groove in which resides an O-ring, and the wiper and the O-ring are each formed of an elastomer having a durometer of between about 70 and 95 Shore A. The wiper is harder than the O-ring.

In still another aspect, the primary seal is formed from a high wear resistance elastomer.

One object of the present invention is to provide an improved packing seal for a reciprocating pump. Related objects and advantages of the invention will become apparent from the following description.

DETAILED DESCRIPTION OF INVENTION

Figure 1:
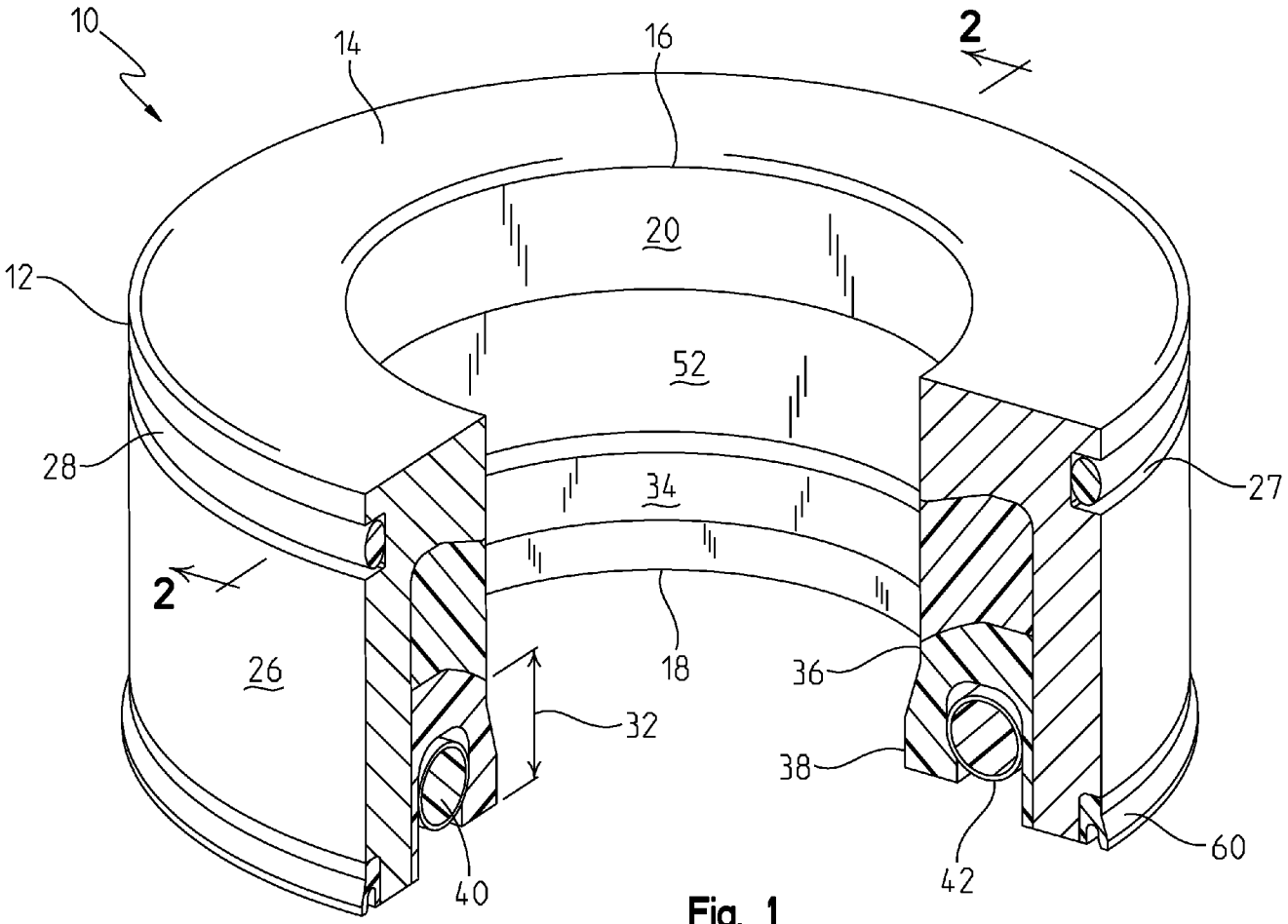
FIG. 1 is an isometric view of the seal of the invention with a section removed to better illustrate the geometry of the seal body and inner and outer walls and surfaces of the invention.

Referring to FIG. 1, one embodiment of the invention provides a seal 10 for a reciprocating pump. The seal may comprise part of a series of sealing rings that make up a seal packing. In another embodiment, the seal 10 of the invention replaces a plurality of seals. The seal 10 of the invention includes an outer seal cartridge 12 having a rigid body 14 defining an open top 16 (low pressure side of seal 10), an open bottom 18 (high pressure side of seal 10) and inner 20 and outer 26 wall portions. The body 14 is preferably L shaped so that the cartridge body extends across the full width of the seal at the top 16 of the cartridge 12 but not at the bottom 18 to define a seal spine that extends between the top 16 and bottom 18. An annular recess 24 is formed in the inner portion of the cartridge wall.

A seal body 30 is contained in recess 24. The seal body includes a primary seal 32 and a harder secondary seal 50 located above the primary seal. The seals have inner wall portions 34, 52 for contacting the plunger 25. The inner wall portion 52 of the secondary seal 50 contacts the plunger at a location above that where the primary seal 32 does. The inner wall portion 34 of the primary seal includes a flat top 36, a flat bottom 38, and an inwardly sloped portion 33 connecting the top and bottom portions.

The seal body 30 is, preferably, a single monolithic body having dual durometers. Hence, the terms "seal" and "seals" will in some instances be used in later paragraphs to describe the primary seal 32, the secondary seal 50, and the primary and secondary seal together. The seal body 30 may replace various types of single ring structures that typically make up the soft sealing components of the packing set, such as the junk, header and/or pressure rings for example. Such ring components and their assembly in a stuffing box is described and shown in Applicants' sister application, U.S. Ser. No. 13/733,749, titled Header Ring for Reciprocating Pump, which is incorporated herein by reference. The instant seal 30 and cartridge 12 are monolithic and thus eliminate the cost and loss of man hours associated with manufacture and use of a multiple ring sealing assembly.

Figure 2:
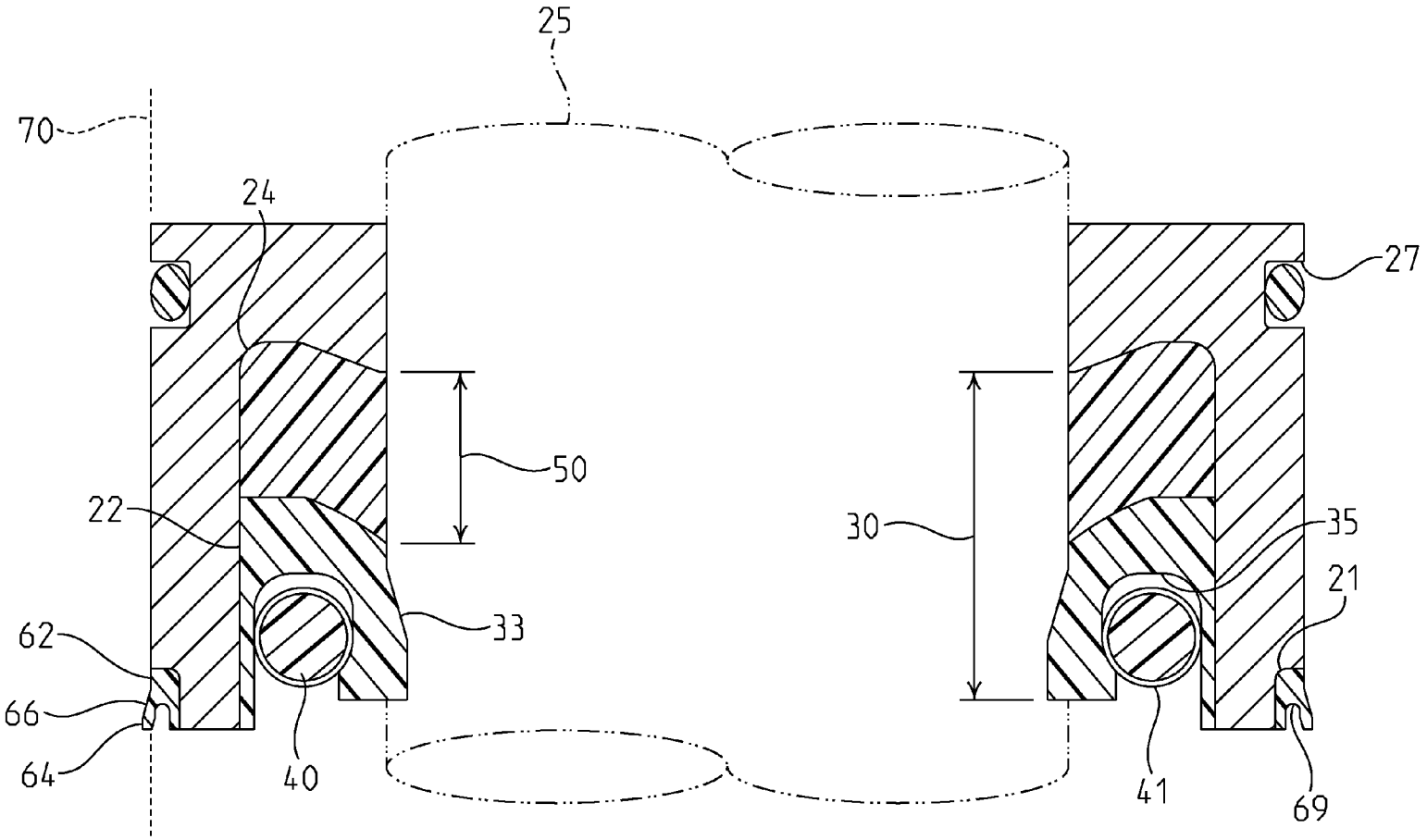
FIG. 2 is an enlarged cross sectional view of the seal of the invention taken along line 2-2 of FIG. 1. A partial cutaway of an exemplary plunger of a reciprocating pump has been added in phantom lines.

In the illustrated example, the flat bottom portion 38 of the seal is shown to be substantially parallel with the vertical, represented by the stuffing box wall 70 shown in phantom in FIG. 2, but in another embodiment, the flat portion 38 may be formed inwardly or outwardly at an angle of between about minus twenty degrees (−20°) and twenty degrees (20°) relative to the vertical (0°). In more preferred embodiments the flat portion 38 is formed in a manner such that it is angled inwardly (relative to the vertical showing in FIGS. 1 and 2) toward the plunger wall (FIG. 2) to between about zero (0°) and twenty degrees (20°).

An annular undercut 35 containing a coil spring 42 is also formed at the bottom of the inner wall of the primary seal 32. An O-ring 40 is preferably positioned within the hollow of the coil part of the spring 42. An elastomeric filament (not shown) may be wrapped with the spring to provide additional resiliency and strength to its biasing force. The O-ring 40 also provides added support so that the spring 42 is capable of withstanding pressure shocks it receives attributable to suction and discharge pressures, which typically approximate 100 psi and 12,000 psi, respectively, in a 200 stroke per minute cycle characteristic in applicable well servicing applications.

The exterior annular recess 21 of the outer wall 26 of the cartridge 12 includes an outer wiper 60, and an O-ring 28 resides in the O-ring groove 27. The outer wiper 60 includes a flat top portion 62, a flat bottom portion 64, and an outwardly sloped middle portion 66 connecting the top and lower portions. The bottom 68 of the outer wiper 60 has an inwardly extending annular ledge 69. At least a part of the flat lower portion 64 contacts the interior wall 70 of the bore, or stuffing box keeping it sealed and clean.

In some embodiments, the seal body 30 may be formed as a homogeneous elastomer ring. The body 30 can be made from a number of different natural or synthetic rubbers as, for example, nitrile or butadiene rubber, with a desired degree of hardness depending upon the use to which the plunger pump 25 is exposed. The body 30 may be formed from an elastomer having a durometer of between about seventy (70) and ninety-five (95) Shore A. In another embodiment, the primary seal 32 and the secondary seal 50 are formed from different materials, and the secondary seal is harder than the primary seal.

In some embodiments, the seal body 30 or at least a portion thereof is formed from ultra-high-molecular-weight polyethylene (UHMWPE), e.g., perfluoroalkoxy (PFA), polyurethane, and/or other thermo or thermoset plastics. In other embodiments, body 30 or at least a portion thereof is formed from a fluoronated polymer, e.g., polytetrafluoroethylene (PTFE)-based material, fluoronated ethylene propylene (FEP).

In yet another embodiment the body 30 or at least a portion thereof is formed from a rigid and/or nonrigid composite elastomer using known means. Some portions and parts of the body 30 may, in some embodiments, be harder than others and/or have various values of hardness and include materials, such as fiber, filler or elastomer coated fabric, for example, to yield desirable physical properties driven by the particular environment of the application, such as ambient temperatures, pressures or pHs. In one embodiment, body 30 or at least a portion thereof is formed from a fluorocarbon.

In more preferred embodiments, the seal body 30 and outer wiper 60, or at least portions thereof, are formed from a high wear resistance/self-lubricated fluoroelastomer (FKM (FPM by ISO)) having a coefficient of friction between about 0.05 to 0.10, e.g., VITON®, and which may withstand pressure cycles of up to 20,000-30,000 psi. In other embodiments, the seal body 30 and outer wiper 60, or at least portions thereof, are formed from a nonabrasive elastomer preferably containing graphite and/or rubber constituents, e.g., Hydrogenated Nitrile Butadiene Rubber (HNBR).

The materials identified and discussed herein with respect to the seal 30 may be used to form the other parts of the seal, or at least portions thereof, including the cartridge 12, outer wiper 60, and O-rings 28, 40 using known techniques.

Additionally, the above materials, compositions, and/or constituent elements forming the particular plastics discussed and their corresponding physical properties, however, should not be construed as limiting. Other materials, compositions, and/or constituent elements forming rigid and non-rigid materials or plastics possessing the physical properties useful in a manner as herein described may be appropriately desirable and availed using different materials, compositions, and/or constituent elements without undue experimentation and should be considered to fall within the scope of Applicants' invention.

The cartridge 12, however, is preferably formed from a rigid material such as metal, plastic, a plastic/rubber composite, or the like so that the cartridge resists deformation and wear while providing axial support to the packing, or stack, thus preventing extrusion of the seal(s) 30, 32, 50 into the fluid end during installation. The L shaped body 14 transfers axial force that is applied to the packing set and seal 10 when the gland nut is tightened. Consequently, the material(s) of seal body 30 is not extruded into the fluid end of the well bore. The cartridge, or at least a portion thereof, preferably, is formed from polyetheretherketone (PEEK) and has a durometer of between about 80 and 95 Shore D.

In other embodiments, the cartridge 12 or at least a portion thereof may be formed from a rigid and/or nonrigid material using known molding means. Some portions and parts of the cartridge may, in some embodiments, be harder than others and/or have varying hardness and other physical properties. In one embodiment, the cartridge 12 is formed from a fluorocarbon. In another, the cartridge, or at least a portion thereof, is formed from a substance having a coefficient of friction between about 0.05 to 0.10 so that it is self-lubricated.

In one embodiment, the outer wiper 60 is formed from an elastomer. More preferably, the outer wiper is formed from an elastomer having a durometer of between about 70 and 95 Shore A. Most preferably, the outer wiper 60 is formed from a nonabrasive elastomer.

The invention provides a single unitary seal 10. The primary 32 and secondary 50 seals are monolithic or may be held together by a rigid cartridge 12, which prevents them from becoming dislodged from the packing or damaged. Additionally, the rigid cartridge 12 protects the seals 32, 50 from being extruded into the fluid end when the gland nut is accidentally over-torqued. Thus, the need for measuring torque and carefully adjusting the gland nut of the stuffing box is unnecessary with the new seal. The nut is less likely to back off the stuffing box during operation, and convenient change-out of the seal in the field is achieved with substantially less effort.

When packed around a plunger 25, the coil spring 42 of the primary seal 32 urges the flat bottom 38 of the primary seal 32 inwardly in a direction away from the cartridge 12 and thus, exerts an optimal load against the plunger 25. The new primary seal 32 is adjusted automatically. The angled bottom 38 can be adjusted to accommodate numerous types of sealing/wiper applications. This forms an improved seal that is self-cleaning. Seal life is also made optimal as a result.

The outer wiper 60 and O-ring 40 carried by the outer wall portion 26 of the cartridge 12 rides against the wall of the bore 70 of the stuffing box keeping it sealed and clean as well. The seals, cartridge and wiper may be formed from rigid plastics having low coefficients of friction and physical properties comprising low abrasion and wear resistance.

For the purposes of promoting an understanding of the principles of the invention, specific embodiments have been described. It should nevertheless be understood that the description is intended to be illustrative and not restrictive in character, and that no limitation of the scope of the invention is intended. Any alterations and further modifications in the described components, elements, processes, or devices, and any further applications of the principles of the invention as described herein, are contemplated as would normally occur to one skilled in the art to which the invention relates.

The invention claimed is:

1. A seal comprising:

an outer seal cartridge having a rigid body defining an open top, an open bottom, an inner wall portion with an inner wall surface for contacting a plunger, the inner wall portion including an interior annular recess;

a seal body in the recess, said seal body also having an inner wall portion for contacting the plunger, the inner wall portion of said seal body comprising a top flat portion, a bottom flat portion, and an inwardly sloped portion connecting the top and bottom flat portions, the seal body defining a primary seal and a secondary seal, the primary seal formed from an elastomer having a durometer of between 70 and 95 Shore A and the secondary seal being harder than the primary seal; and the outer wall portion of the seal cartridge having an annular recess, an outer wiper in the recess for wiping a wall of a bore, said outer wiper having a top flat portion, a bottom flat portion, and an outwardly sloped middle portion connecting the top and bottom portions.

2. A seal according to claim 1, wherein the seal body and the outer wiper are integrally formed with or connected to the seal cartridge to define a single unit.

3. A seal according to claim 1, wherein the body of the seal cartridge comprises an outer wall portion having a top with an O-ring groove in which resides an O-ring, and the wiper and the O-ring are each formed of an elastomer having a durometer of between about 70 and 95 Shore A, the wiper is harder than the O-ring.

4. A seal according to claim 1, wherein the primary seal, the secondary seal and the outer wiper are integrally formed with or connected to the seal cartridge to define a single unit.

5. A seal comprising:

an outer seal cartridge having a body defining an open top, an open bottom, an inner wall portion with an inner wall surface for contacting a plunger, the inner wall portion including an interior annular recess; and a seal body in the recess, said seal body comprising, a primary seal having an inner wall portion for contacting the plunger, the inner wall portion of said primary seal comprising a top flat portion, a bottom flat portion, and an inwardly sloped portion connecting the top and bottom flat portions, the primary seal having an annular undercut in which resides an O-ring for urging at least the bottom flat portion of the seal body against said plunger, and a secondary seal with an inner wall portion for contacting the plunger; and wherein the body of the seal cartridge comprises an outer wall portion having an annular recess and a wiper in the recess for wiping a wall of a bore, the wiper having top flat portion, a bottom flat portion, and an outwardly sloped middle portion connecting the top and bottom flat portions.

6. A seal according to claim 5, wherein the primary and the secondary seals are integrally formed from a homogeneous elastomer, and the secondary seal is harder than the primary seal.

7. A seal according to claim 6, wherein a flat rigid coil spring is wrapped around the O-ring in the annular undercut of the primary seal.

8. A seal according to claim 5, wherein the body of the seal cartridge comprising an outer wall portion having a top with an O-ring groove in which resides an O-ring, and the wiper and the O-ring are each formed of an elastomer having a durometer of between about 70 and 95 Shore A, the wiper is harder than the O-ring.

9. A seal according to claim 8, wherein the body of the seal cartridge comprising an outer wall portion having an annular recess, a wiper in the recess for wiping a wall of a bore, said wiper having a top flat portion, a bottom flat portion, and an outwardly sloped middle portion connecting the top and bottom flat portions.

10. A seal according to claim 5, wherein a flat rigid coil spring is wrapped around the O-ring in the annular undercut of the primary seal.

11. A seal according to claim 10, wherein the O-ring in the annular undercut of the primary seal and the primary seal are each formed of an elastomer having a durometer of between about 70 and 95 Shore A, the primary seal is harder than the O-ring.

12. A seal comprising:

an outer seal cartridge having a rigid body defining an open top, an open bottom, an inner wall portion with an inner wall surface for contacting a plunger, said body being L shaped so that the cartridge body extends across the full width of said seal at the top of the cartridge but not at the bottom, thereby defining a seal spine, the inner wall portion including an interior annular recess;

a seal body in the recess, said seal body comprising, a primary seal having an inner wall portion for contacting the plunger, the inner wall portion of said primary seal comprising a flat top, a flat bottom, and an inwardly sloped portion connecting the top and bottom, the primary seal having an annular undercut in which resides a coil spring for urging at least the flat bottom of the inner wall portion against said plunger, a secondary seal having an inner wall portion for contacting the plunger at a location above that where the primary seal contacts said plunger; and an annular recess formed in an outer wall portion of the seal cartridge, an outer wiper in the recess for wiping a wall of a bore, said outer wiper having a top flat portion, a bottom flat portion, and an outwardly sloped middle portion connecting the top and bottom portions.

13. A seal according to claim 12, wherein the primary seal, the secondary seal and the outer wiper are integrally formed with or connected to the seal cartridge and movable as a single unit.

14. A seal according to claim 13, wherein said outer wiper is formed from a nonabrasive elastomer.

15. A seal according to claim 14, wherein the primary seal is formed from a high wear resistance elastomer.

16. A seal according to claim 13, wherein the body of the seal cartridge comprising an outer wall portion having a top with an O-ring groove in which resides an O-ring, and the wiper and the O-ring are each formed of an elastomer having a durometer of between about 70 and 95 Shore A, the wiper is harder than the O-ring.

17. A seal according to claim 16, wherein the primary seal is formed from a high wear resistance elastomer.

18. A seal according to claim 17, wherein an O-ring is located inside said coil spring in the annular undercut of the primary seal.

19. A seal according to claim 18, wherein the primary and the secondary seals are integrally formed from a homogeneous elastomer, and the secondary seal is harder than the primary seal.

20. A seal according to claim 17, wherein the primary and the secondary seals are integrally formed from a homogeneous elastomer, and the secondary seal is harder than the primary seal.

21. A seal according to claim 13, wherein the primary seal is formed from a high wear resistance elastomer.

* * * * *